US010890177B2

(12) United States Patent
Hagihara

(10) Patent No.: US 10,890,177 B2
(45) Date of Patent: Jan. 12, 2021

(54) FUEL PUMP FOR PRESSURIZING LOW PRESSURE FUEL SUCTIONED INTO A PRESSURIZING CHAMBER AND DISCHARGING HIGH PRESSURE FUEL PRESSURIZED IN THE PRESSURIZING CHAMBER

(71) Applicant: DENSO CORPORATION, Kariya (JP)

(72) Inventor: Naoyuki Hagihara, Kariya (JP)

(73) Assignee: DENSO CORPORATION, Kariya (JP)

( * ) Notice: Subject to any disclaimer, the term of this patent is extended or adjusted under 35 U.S.C. 154(b) by 202 days.

(21) Appl. No.: 16/108,458

(22) Filed: Aug. 22, 2018

(65) Prior Publication Data

US 2019/0107106 A1 Apr. 11, 2019

(30) Foreign Application Priority Data

Oct. 11, 2017 (JP) ..... 2017-197906

(51) Int. Cl.
*F04B 49/22* (2006.01)
*F02M 37/00* (2006.01)
(Continued)

(52) U.S. Cl.
CPC ..... *F04B 49/225* (2013.01); *F02M 37/00* (2013.01); *F02M 55/04* (2013.01); *F02M 59/46* (2013.01);
(Continued)

(58) Field of Classification Search
CPC .... F04B 49/225; F04B 7/0076; F04B 1/0461; F04B 23/04; F04B 49/243; F04B 1/053; F04B 9/042; F02M 37/00; F02M 59/46; F02M 55/04; F02M 63/005; F02M 63/004; F02M 2200/315; F02M 63/0225; F02M 37/18; F01N 2610/1433; F01N 2610/03; F01N 3/0253
See application file for complete search history.

(56) References Cited

U.S. PATENT DOCUMENTS 4,094,465 A 6/1978 Bastenhof
6,058,912 A * 5/2000 Rembold ..... F02D 41/3082 123/179.17
(Continued)

FOREIGN PATENT DOCUMENTS

EP 1 609 979 12/2005

*Primary Examiner* — David Hamaoui
(74) *Attorney, Agent, or Firm* — Nixon & Vanderhye P.C.

(57) ABSTRACT

A metering valve is installed in a feed passage that supplies low pressure fuel, which is fed from a feed pump, to a pressurizing chamber. The metering valve adjusts a discharge amount of the low pressure fuel discharged from the pressurizing chamber. A first pressure regulating valve is opened in a case where a pressure of the low pressure fuel becomes equal to or larger than a first preset pressure. A second pressure regulating valve is opened in a case where the pressure of the low pressure fuel becomes equal to or larger than a second preset pressure. The first pressure regulating valve and the second pressure regulating valve are configured such that a degree of responsiveness of valve opening and closing of the second pressure regulating valve is higher than a degree of responsiveness of valve opening and closing of the first pressure regulating valve.

10 Claims, 7 Drawing Sheets

(51) Int. Cl.

| | |
|---|---|
| ***F04B 7/00*** | (2006.01) |
| ***F04B 1/0461*** | (2020.01) |
| ***F04B 23/04*** | (2006.01) |
| ***F02M 59/46*** | (2006.01) |
| ***F02M 55/04*** | (2006.01) |
| ***F02M 63/00*** | (2006.01) |
| ***F04B 49/24*** | (2006.01) |
| *F04B 1/053* | (2020.01) |
| *F04B 9/04* | (2006.01) |
| *F02M 63/02* | (2006.01) |

(52) U.S. Cl.

CPC ..... *F02M 63/004* (2013.01); *F02M 63/005* (2013.01); *F04B 1/0461* (2013.01); *F04B 7/0076* (2013.01); *F04B 23/04* (2013.01); *F04B 49/243* (2013.01); *F02M 63/0225* (2013.01); *F02M 2200/315* (2013.01); *F04B 1/053* (2013.01); *F04B 9/042* (2013.01)

(56) References Cited

U.S. PATENT DOCUMENTS

| | | | | |
|---|---|---|---|---|
| 6,196,191 | B1 * | 3/2001 | Rembold | F02M 55/025 123/447 |
| 6,722,857 | B1 | 4/2004 | Kellner et al. | |
| 6,772,738 | B2 * | 8/2004 | Rembold | F02D 41/3854 123/456 |
| 7,343,901 | B2 * | 3/2008 | Mori | F02M 37/22 123/446 |
| 8,171,721 | B2 * | 5/2012 | Boddy | F01N 11/002 60/286 |
| 9,752,530 | B2 * | 9/2017 | Surnilla | F02D 35/027 |

* cited by examiner

FUEL PUMP FOR PRESSURIZING LOW PRESSURE FUEL SUCTIONED INTO A PRESSURIZING CHAMBER AND DISCHARGING HIGH PRESSURE FUEL PRESSURIZED IN THE PRESSURIZING CHAMBER

CROSS REFERENCE TO RELATED APPLICATION

This application is based on and incorporates herein by reference Japanese Patent Application No. 2017-197906 filed on Oct. 11, 2017.

TECHNICAL FIELD

The present disclosure relates to a fuel pump that pressurizes and discharges fuel.

BACKGROUND

For example, JP2003-502542A (corresponding to U.S. Pat. No. 6,722,857B1) discloses a fuel pump that includes: a plunger, which pressurizes low pressure fuel in a pressurizing chamber after feeding of the low pressure fuel from a feed pump to the pressurizing chamber; and a metering valve, which adjusts a discharge amount of the pressurized high pressure fuel to be discharged from the pressurizing chamber through adjustment of the amount (pressurized amount) of the low pressure fuel that serves as a pressurizing subject. Specific examples of the metering valve may include: an SCV (Suction Control Valve), which adjusts a valve opening degree thereof in a downward-moving stroke of the plunger to adjust the suctioned amount of the low pressure that is suctioned into the pressurizing chamber; and a PCV (Pressure Control Valve), which adjusts valve closing timing thereof in an upward-moving stroke of the plunger to adjust timing of starting the pressurization of the low pressure fuel.

Furthermore, the fuel pump, which is recited in the JP2003-502542A (corresponding to U.S. Pat. No. 6,722,857B1), includes a pressure regulating valve that is installed in a passage (feed passage), which supplies the low pressure fuel to the metering valve. The pressure regulating valve is opened in a case where the pressure of the low pressure fuel becomes equal to or larger than a preset pressure to stabilize the pressure (feed pressure) of the low pressure fuel to be supplied to the metering valve. In this way, the accuracy of adjusting the pressurized amount of the fuel through the metering valve is improved.

A waveform (pump characteristic waveform), which indicates a relationship between a pump rotational speed and a pump discharge pressure of the feed pump, becomes a waveform that is configured such that the higher the rotational speed is, the larger the discharge pressure is. However, an actual pump characteristic waveform does not become a waveform that is configured such that the pump discharge pressure monotonically increases in response to an increase in the pump rotational speed. Rather, in a more precise sense, the actual pump characteristic waveform becomes a waveform that is configured such that the pump discharge pressure pulsates and increases while repeating an increase and a decrease of the pump discharge pressure in response to the increase in the pump rotational speed. As a result, the pump discharge pressure instantaneously and largely changes in response to a small change in the pump rotational speed. Therefore, the inventor of the present application has obtained the following knowledge. Specifically, although the previously proposed pressure regulating valve can adjust an average value of the fluctuating pump discharge pressure in a range that is smaller than a preset value, the previously proposed pressure regulating valve cannot sufficiently limit the instantaneous change in the pump discharge pressure caused by the pulsation of the pump characteristic waveform described above. That is, the previously proposed fuel pump may need to improve an accuracy of adjusting the pressurized amount of the fuel through the metering valve and may need to improve stability of the discharge amount of the high pressure fuel.

SUMMARY

In view of the above disadvantages, it is an objective of the present disclosure to provide a fuel pump that improves stability of a discharge amount of high pressure fuel.

In order to achieve the above objective, according to the present disclosure, there is provided a fuel pump configured to pressurize low pressure fuel suctioned into a pressurizing chamber and discharge high pressure fuel, which is pressurized in the pressurizing chamber, from the pressurizing chamber, the fuel pump comprising:

a feed passage that supplies the low pressure fuel, which is fed from a feed pump, to the pressurizing chamber;

a metering valve that is installed in the feed passage, wherein the metering valve adjusts a supply amount of the low pressure fuel supplied to the pressurizing chamber or adjusts a discharge amount of the low pressure fuel discharged from the pressurizing chamber, so that the metering valve adjusts an amount of the low pressure fuel that is a pressurizing subject to be pressurized in the pressurizing chamber;

a first return passage that is connected to a portion of the feed passage located on an upstream side of the metering valve and returns the low pressure fuel to an upstream side of the feed pump;

a first pressure regulating valve that includes a first valve element, which is configured to open and close the first return passage, and a first resilient element, which applies a resilient force to the first valve element toward a valve closing side, while the first valve element is opened against the resilient force of the first resilient element in a case where a pressure of the low pressure fuel becomes equal to or larger than a first preset pressure;

a second return passage that is connected to a portion of the feed passage located on an upstream side of the metering valve and returns the low pressure fuel to the upstream side of the feed pump; and a second pressure regulating valve that includes a second valve element, which is configured to open or close the second return passage, and a second resilient element, which applies a resilient force to the second valve element toward a valve closing side, while the second valve element opens against the resilient force of the second resilient element in a case where the pressure of the low pressure fuel becomes equal to or larger than a second preset pressure, wherein:

the first pressure regulating valve and the second pressure regulating valve are configured such that a degree of responsiveness of valve opening and closing of the second pressure regulating valve is higher than a degree of responsiveness of valve opening and closing of the first pressure regulating valve.

According to the above-described fuel pump, the first pressure regulating valve is opened when the pump discharge pressure becomes equal to or larger than the first preset pressure. Therefore, even when the pump discharge pressure largely pulsates in response to a slight change in the pump rotational speed due to the pulsation of the pump characteristic waveform described above, the pulsating pump discharge pressure can be adjusted such that an average value of the pulsating pump discharge pressure does not increase beyond the first preset pressure. Thus, the low pressure fuel, which has the stabilized average value (average feed pressure) of the pressure of the low pressure fuel to be supplied to the metering valve, can be fed to the metering valve.

Furthermore, the fuel pump described above includes the second pressure regulating valve that has the high degree of responsiveness. Therefore, the second pressure regulating valve can be opened in response to an instantaneous change in the pump discharge pressure to limit the instantaneous change in the pump discharge pressure although the first pressure regulating valve cannot respond to such an instantaneous change in the pump discharge pressure. As a result, it is possible to limit the pulsation of the pump discharge pressure on the high pressure side of the average of the pulsation of the pump discharge pressure under the circumstance where the average value of the pump discharge pressure is smaller than the second preset pressure.

As discussed above, since the fuel pump described above includes the second pressure regulating valve, which has the high degree of responsiveness, in addition to the first pressure regulating valve, the pulsation toward the high pressure side of the feed pressure can be limited by the second pressure regulating valve while the average feed pressure is stabilized by the first pressure regulating valve. As a result, it is possible to stabilize the pressure of the fuel, which is adjusted by the metering valve, i.e., the pressure of the low pressure fuel, which serves as the pressurizing subject. Thus, the stability of the discharge amount of the high pressure fuel can be improved.

BRIEF DESCRIPTION OF THE DRAWINGS

The present disclosure, together with additional objectives, features and advantages thereof, will be best understood from the following description, the appended claims and the accompanying drawings in which:

DETAILED DESCRIPTION

Hereinafter, embodiments of the present disclosure will be described. In the following respective embodiments, corresponding structural elements are indicated by the same reference signs and may not be redundantly described. In a case where only a part of a structure is described in each of the following embodiments, the rest of the structure of the embodiment may be the same as that of previously described one or more of the embodiments. Besides the explicitly described combination(s) of structural components in each of the following embodiments, the structural components of different embodiments may be partially combined even though such a combination(s) is not explicitly described as long as there is no problem. The combination(s) of the structural components of the embodiments and modifications, which are not explicitly described, is assumed to be disclosed by the following description.

First Embodiment

Figure 1:
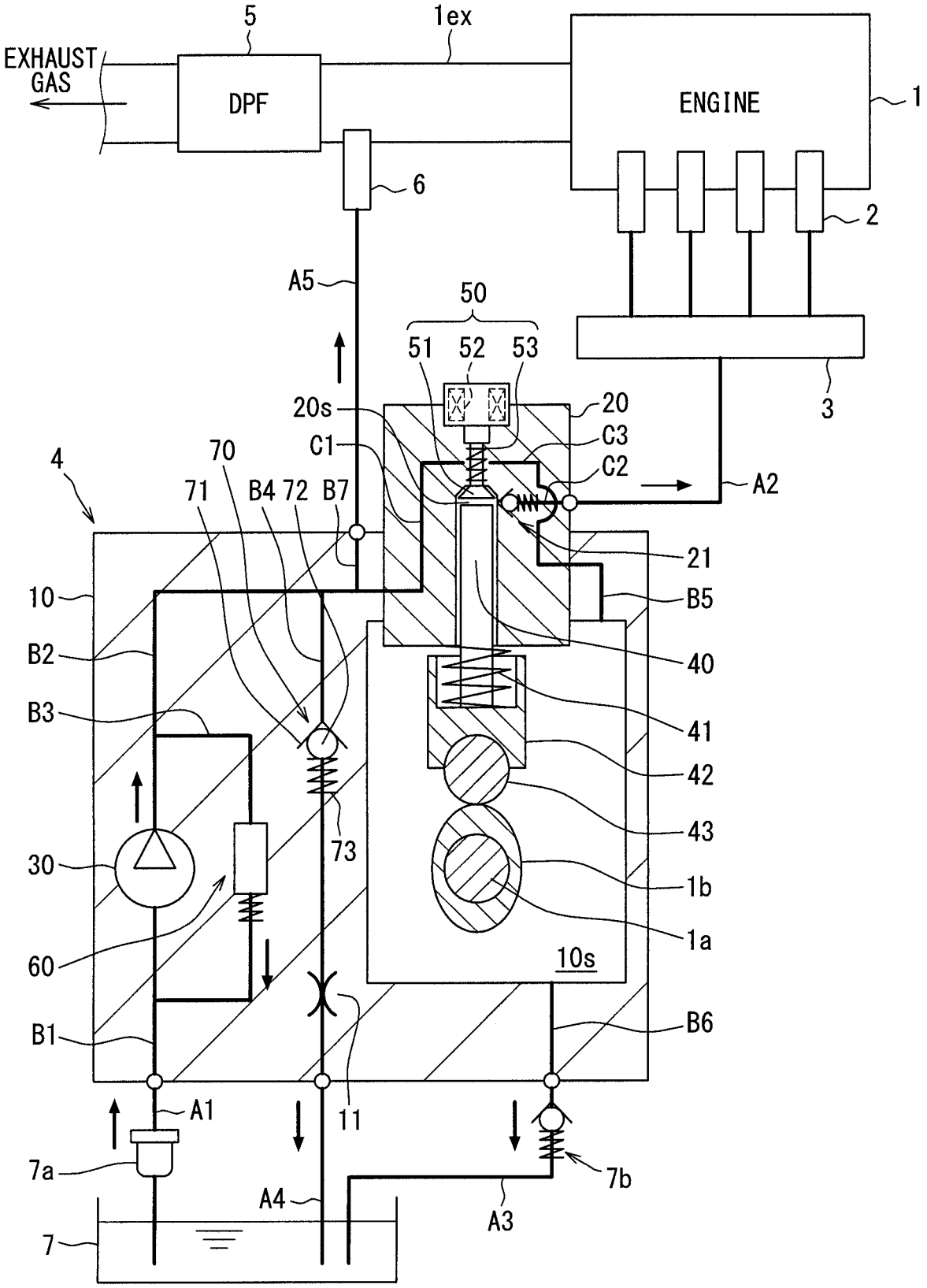
FIG. 1 is a schematic diagram showing a cross section of a fuel pump according to a first embodiment.

A combustion system shown in FIG. 1 includes an internal combustion engine 1, a plurality of fuel injection valves 2, a common rail 3, a high pressure pump 4 (fuel pump), a DPF (Diesel Particulate Filter) 5 and a low pressure injection valve 6 and is installed to a vehicle. The internal combustion engine 1 is a compression self-igniting internal combustion type that combusts fuel, such as light oil. Each of the fuel injection valves 2 is installed to a cylinder head of the internal combustion engine 1 and injects high pressure liquid fuel (hereinafter referred to as high pressure fuel) into a corresponding combustion chamber. The common rail 3 stores the high pressure fuel fed from the high pressure pump 4 and distributes the high pressure fuel to the fuel injection valves 2. A pressure of the high pressure fuel, which is fed from the high pressure pump 4, is, for example, 150 MPa to 300 MPa.

The DPF 5, which is also simply referred to as a particulate filter, is installed to an exhaust pipe 1*ex*, which is connected to the internal combustion engine 1, to capture particulate components contained in the exhaust gas. When an amount of captured particles exceeds a predetermined amount, a regeneration control operation, which regenerates the DPF 5 by combusting the captured particles, is executed.

The low pressure injection valve 6 is installed to a portion of the exhaust pipe 1*ex*, which is located on an upstream side of the DPF 5, to inject the low pressure fuel, which is supplied from the high pressure pump 4, into an exhaust passage. A pressure of the low pressure fuel, which is supplied from the high pressure pump 4, is, for example, 0.5 MPa to 3 MPa. The low pressure injection valve 6 is controlled such that the low pressure injection valve 6 injects the low pressure fuel in a case where the regeneration control operation described above is demanded. The particles, which are captured by the DPF 5, are combusted when the injected fuel undergoes an oxidation reaction at the DPF 5.

The high pressure pump 4 is driven by using an output of the internal combustion engine 1 as a drive source, so that the high pressure pump 4 suctions the liquid fuel stored in the fuel tank 7 and discharges the suctioned fuel to the common rail 3 after pressurization of the suctioned fuel.

Furthermore, the high pressure pump 4 supplies the low pressure fuel before the pressurization thereof at a pressurizing chamber 20*s* to the low pressure injection valve 6. Hereinafter, a structure of the high pressure pump 4 will be described in detail.

The high pressure pump 4 includes a main body portion 10 and a cylinder portion 20, each of which is in a form of a metal block. The high pressure pump 4 further includes a feed pump 30, a plunger 40, a metering valve 50, a discharge valve 21, a first pressure regulating valve 60, a second pressure regulating valve 70 and an orifice member 11. The cylinder portion 20, the feed pump 30, the first pressure regulating valve 60, the second pressure regulating valve 70 and the orifice member 11 are installed to the main body portion 10. The plunger 40, the metering valve 50 and the discharge valve 21 are installed to the cylinder portion 20.

A plurality of fuel passages, which include a suction passage B1, a feed passage B2, a first return passage B3, a second return passage B4, an excess discharge passage B5, a cam discharge passage B6 and a sub-supply passage B7, is formed in an inside of the main body portion 10. Furthermore, a cam chamber 10*s* is formed in the inside of the main body portion 10.

An inflow pipe A1 is connected to a port that forms a flow inlet of the suction passage B1 at the main body portion 10. A low pressure supply pipe A5 is connected to a port that forms a flow outlet of the sub-supply passage B7 at the main body portion 10. A first drain pipe A3 is connected to a port that forms a flow outlet of the cam discharge passage B6 at the main body portion 10. A second drain pipe A4 is connected to a port that forms a flow outlet of the second return passage B4 at the main body portion 10.

A fuel filter 7*a*, which captures foreign objects contained in the fuel, is installed to the inflow pipe A1. A pressure regulating valve 7*b* is installed to the first drain pipe A3. The pressure regulating valve 7*b* opens to discharge the fuel from the cam chamber 10*s* through the cam discharge passage B6 when the pressure of the fuel in the cam discharge passage B6 becomes equal to or larger than a preset pressure.

A feed passage C1, a discharge passage C2, an excess discharge passage C3 and the pressurizing chamber 20*s* are formed in an inside of the cylinder portion 20. A high pressure discharge pipe A2 is connected to a port that forms a flow outlet of the discharge passage C2.

The feed pump 30 is driven by an output of an electric motor (not shown), which serves as a drive source, so that the feed pump 30 suctions the fuel stored in the fuel tank 7 and discharges the low pressure fuel after pressurization of the suctioned fuel. Specifically, the feed pump 30 includes: a trochoid gear, which is rotated by the electric motor; and a housing, which receives the trochoid gear. A suction inlet, which is formed at the housing, is communicated with a downstream end of the suction passage B1, and a discharge outlet, which is formed at the housing, is communicated with an upstream end of the feed passage B2. The fuel is suctioned from the suction passage B1 into the inside of the housing by rotating the trochoid gear, and the suctioned fuel in the housing is transferred by the trochoid gear and is discharged to the feed passage B2.

A pressure of the low pressure fuel immediately after the discharging of the low pressure fuel from the feed pump 30 will be referred to as a pump discharge pressure. Furthermore, a pressure of the low pressure fuel, which is adjusted through the first pressure regulating valve 60 and the second pressure regulating valve 70, i.e., a pressure of the low pressure fuel inputted to the metering valve 50 will be referred to as a feed pressure. The low pressure fuel, which is discharged from the feed pump 30, flows into the pressurizing chamber 20*s* through the feed passage B2 and the feed passage C1.

The plunger 40 is driven by the output of the internal combustion engine 1, which serves as a drive source, so that the plunger 40 pressurizes the low pressure fuel, which is inputted into the pressurizing chamber 20*s*, and the pressurized high pressure fuel is discharged from the high pressure pump 4. Specifically, besides the plunger 40, the high pressure pump 4 further includes a resilient member (spring) 41, a support portion 42 and a contact portion 43. The support portion 42 is held in an upwardly and downwardly movable manner by a cylindrical portion (not shown), which is formed in the main body portion 10. The contact portion 43 is installed to the support portion 42 and contacts a cam 1*b* placed in the cam chamber 10*s*. The cam 1*b* is rotated integrally with a rotatable shaft 1*a* that is rotated by a drive force, which is transmitted from the output shaft of the internal combustion engine 1.

The plunger 40 is upwardly driven by the support portion 42 when the rotating cam 1*b* upwardly drives the contact portion 43 and the support portion 42. The plunger 40 is downwardly driven together with the support portion 42 when the resilient member 41 downwardly drives the support portion 42. Therefore, the plunger 40 reciprocates by repeating the lift up and the lift down according to a profile of the cam 1*b*.

The pressurizing chamber 20*s* is communicated with the feed passage C1, the discharge passage C2 and the excess discharge passage C3. The feed passage C1 communicates between the pressurizing chamber 20*s* and the feed passage B2. The discharge passage C2 communicates between the pressurizing chamber 20*s* and the high pressure discharge pipe A2. The excess discharge passage C3 communicates between the pressurizing chamber 20*s* and the excess discharge passage B5 that is in turn communicated with the cam chamber 10*s*.

The metering valve 50 is an electromagnetic valve and is installed in the feed passage C1 to change between a communicating state, in which the metering valve 50 communicates between the pressurizing chamber 20*s* and the feed passage C1, and a blocking state, in which the metering valve 50 blocks communication between the pressurizing chamber 20*s* and the feed passage C1, to adjust the amount of fuel pressurized by the plunger 40, i.e., a discharge amount of the high pressure fuel. The metering valve 50 includes a valve element 51, an electromagnetic coil 52 and a resilient member (spring) 53. When a control device (not shown) energizes the electromagnetic coil 52, the valve element 51 is driven by an electromagnetic attractive force generated by the electromagnetic coil 52, so that the valve element 51 lifts up (a valve closing movement). In contrast, when the control device stops the energization, the valve element 51 is driven by a force (a resilient force), which is exerted by resilient deformation of the resilient member 53, so that the valve element 51 lifts down (a valve opening movement).

The discharge valve 21 is a mechanical valve installed in the discharge passage C2. In the discharge valve 21, a resilient member (spring) exerts a resilient force to a valve element toward a valve closing side, so that the valve element is closed. The valve element of the discharge valve 21 is opened against the resilient force when the fuel pressure of the pressurizing chamber 20*s* is equal to or larger than a predetermined valve opening pressure. In contrast, the valve element of the discharge valve 21 is closed by the resilient force when the fuel pressure of the pressurizing chamber 20*s* is smaller than the valve opening pressure.

An upstream end of the first return passage B3 is connected to a portion of one of the feed passages B2, C1 located on an upstream side of the metering valve 50. More specifically, the upstream end of the first return passage B3 is connected to the feed passage B2 formed in the main body portion 10. Here, the feed passages B2, C1 may be collectively referred to as a feed passage that supplies the low pressure fuel, which is fed from the feed pump 30, to the pressurizing chamber 20*s*. A downstream end of the first return passage B3 is connected to the suction passage B1. The first return passage B3 returns the low pressure fuel, which is fed from the feed pump 30, to an upstream side of the feed pump 30 (i.e., a side of the feed pump 30 where the fuel tank 7 is placed) in the fuel system (fuel circuit), as shown in FIG. 1.

Figure 2A:
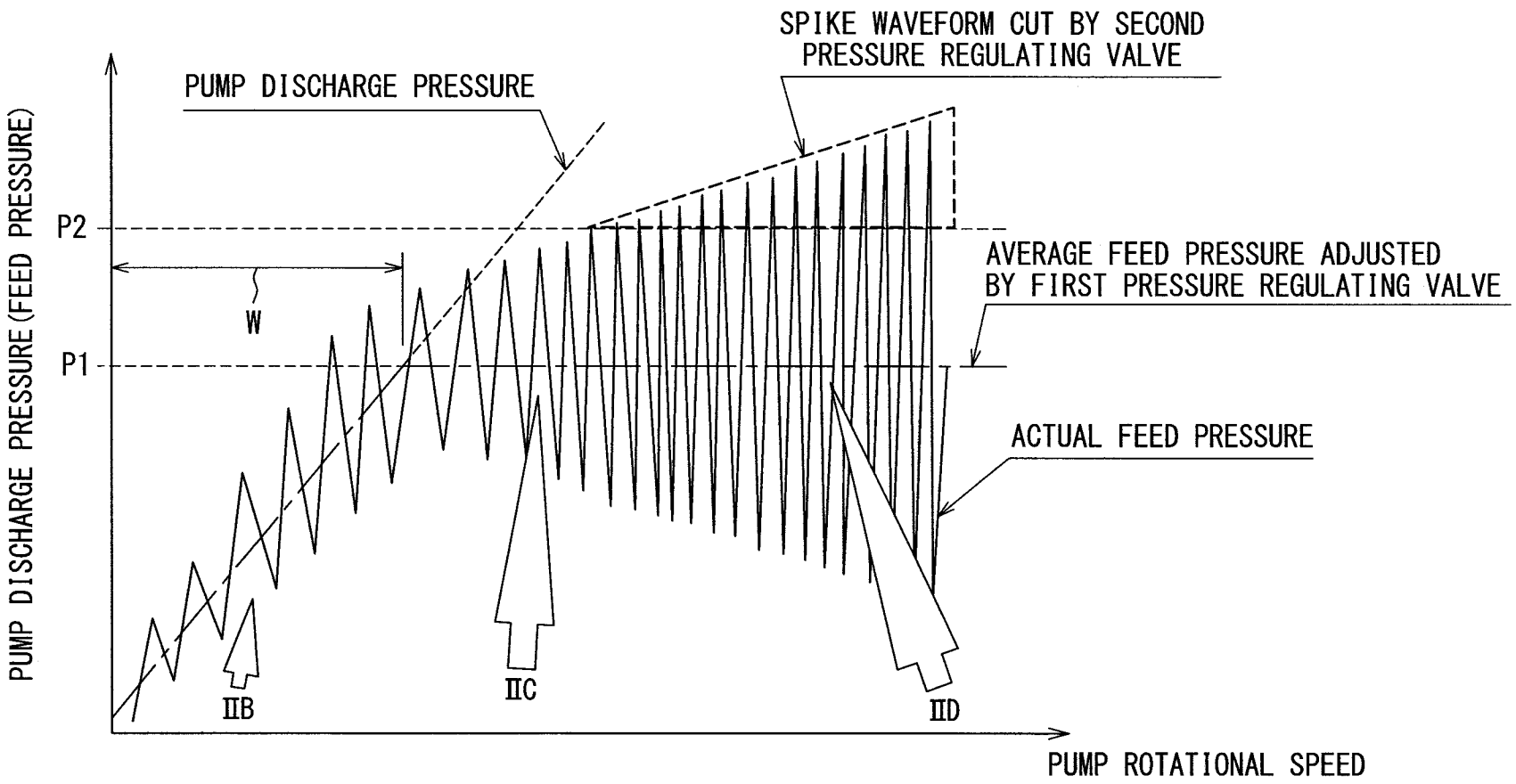
FIG. 2A is a graph indicating a relationship of a pump discharge pressure and a feed pressure of the fuel pump relative to a pump rotational speed according to the first embodiment.

The first pressure regulating valve 60 is installed in the first return passage B3. The first pressure regulating valve 60 is a pressure regulating valve that is configured such that when the pressure of the low pressure fuel applied to the pressure regulating valve is increased, a valve opening degree of the pressure regulating valve is increased to result in an increase in a flow rate of the pressure regulating valve. Specifically, a spool valve shown in FIGS. 2B to 2D is used as the first pressure regulating valve 60 of the present embodiment.

Figure 2B:
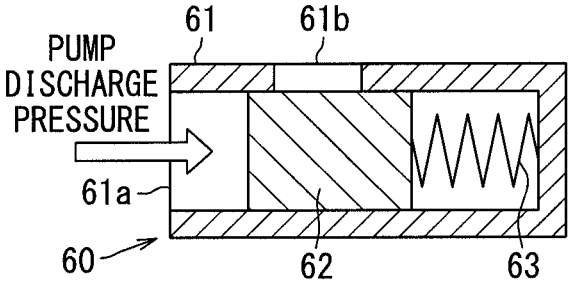
FIG. 2B is a diagram indicating an operational position of a first pressure regulating valve at an operational state IIB shown in FIG. 2A.
Figure 2C:
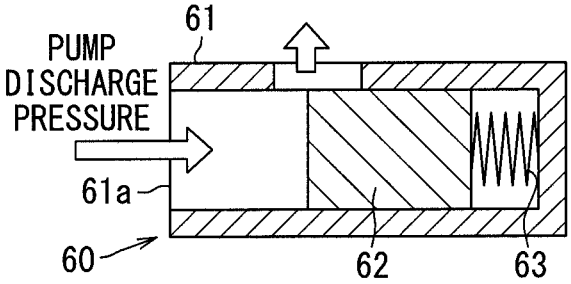
FIG. 2C is a diagram indicating another operational position of the first pressure regulating valve at an operational state IIC shown in FIG. 2A.
Figure 2D:
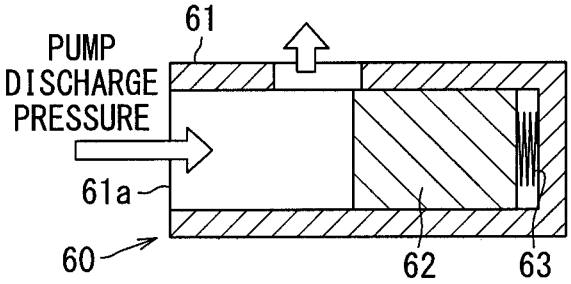
FIG. 2D is a diagram indicating a further operational position of the first pressure regulating valve at an operational state IID shown in FIG. 2A.

As shown in, for example, FIG. 2B, the first pressure regulating valve 60 includes a housing 61, a first valve element 62 and a first resilient element (spring) 63. A flow inlet 61*a* and a flow outlet 61*b*, which communicate with the first return passage B3, are formed at the housing 61. The first valve element 62 is received in the housing 61 in a state where the first valve element 62 is reciprocatable in the housing 61. A seat surface of the first valve element 62 opens or closes the flow outlet 61*b* in response to the reciprocation of the first valve element 62 between two opposite sides.

The first resilient element 63 exerts a resilient force against the first valve element 62 toward one side (a valve closing side) among the two opposite sides of the reciprocation of the first valve element 62. A pump discharge pressure, which is exerted to a pressure receiving surface of the first valve element 62, applies a valve opening force against the first valve element 62 toward the other side (valve opening side) among the two opposite sides of the reciprocation of the first valve element 62. The first valve element 62 is moved to a position (see FIG. 2C), at which the first valve element 62 opens the flow outlet 61*b* against the resilient force of the first resilient element 63 when the pump discharge pressure is equal to or larger than a first preset pressure P1. The first valve element 62 is moved to a position (see FIG. 2B), at which the first valve element 62 closes the flow outlet 61*b* when the pump discharge pressure is smaller than the first preset pressure P1.

Furthermore, the amount of movement of the first valve element 62 toward the valve opening side is increased to increase a degree of valve opening (an opening degree) of the flow outlet 61*b* (see FIG. 2D) when the pump discharge pressure is increased within a pressure range, in which the pump discharge pressure is equal to or larger than the first preset pressure P1.

An upstream end of the second return passage B4 is connected to a portion of one of the feed passages B2, C1, which is located on an upstream side of the metering valve 50, more specifically, the upstream end of the second return passage B4 is connected to a portion of the feed passage B2 formed in the main body portion 10. More specifically, the upstream end of the second return passage B4 is connected to the portion of the feed passage B2, which is located on the downstream side of the portion of the feed passage B2, to which the upstream end of the first return passage B3 is connected. A downstream end of the second return passage B4 is connected to the second drain pipe A4. The second return passage B4 returns the low pressure fuel, which is fed from the feed pump 30, to the fuel tank 7 through the second drain pipe A4. In other words, the second return passage B4 is connected to a portion of the path (the fuel tank 7 in this instance) located on the upstream side of the feed pump 30 in the fuel system while bypassing the cam chamber 10*s*.

The second pressure regulating valve 70 is installed in the second return passage B4. The second pressure regulating valve 70 is a pressure regulating valve that is configured to have a constant valve opening degree regardless of the amount of the pressure of the low pressure fuel. Specifically, a ball valve (ball check valve) shown in FIG. 1 is used as the second pressure regulating valve 70 of the present embodiment.

As shown in FIG. 1, the second pressure regulating valve 70 includes a valve seat 71, a second valve element 72 and a second resilient element (spring) 73. The valve seat 71 is shaped into a ring form that surrounds an opening portion of the second return passage B4. The second valve element 72 is placed in a state where the second valve element 72 is seatable and liftable relative to the valve seat 71.

The second resilient element 73 exerts a resilient force against the second valve element 72 toward the seating side (the valve closing side). The pump discharge pressure, which is exerted against a pressure receiving surface of the second valve element 72, applies a valve opening force against the second valve element 72 toward the lifting side (the valve opening side). The second valve element 72 is lifted from the valve seat 71 against the resilient force of the second resilient element 73 to open the opening portion when the pump discharge pressure is equal to or larger than a second preset pressure P2. The second valve element 72 is seated against the valve seat 71 to close the opening portion when the pump discharge pressure is smaller than the second preset pressure P2.

The first pressure regulating valve 60 and the second pressure regulating valve 70 are configured such that a degree of responsiveness of valve opening and closing of the second valve element 72 is higher than a degree of responsiveness of valve opening and closing of the first valve element 62. Specifically, the degree of responsiveness of the second pressure regulating valve 70 is set to be higher than the degree of responsiveness of the first pressure regulating valve 60 by setting of the pressure receiving surface area and a weight of each of the first valve element 62 and the second valve element 72 and setting of a spring constant of each of the first resilient element 63 and the second resilient element 73.

In other words, since the second pressure regulating valve 70 has the high degree of responsiveness, the second valve element 72 immediately moves to the full opening position when the pump discharge pressure is increased slightly above the second preset pressure P2. Thus, it is understood that the second pressure regulating valve 70 is configured such that the opening degree of the second valve element 72 is made constant (the full opening) regardless the pump discharge pressure under the circumstance where the pump discharge pressure is equal to or larger than the second preset pressure P2. In contrast, since the first pressure regulating valve 60 has the low degree of responsiveness, the first valve element 62 stays in an intermediate position without moving to the full opening position when the pump discharge pressure is increased slightly above the first preset pressure P1. Thus, it is understood that the first pressure regulating valve 60 is configured such that the opening degree of the first valve element 62 is changed in response to the pump discharge pressure under the circumstance where the pump discharge pressure is equal to or larger than the first preset pressure P1.

For example, in a case where the pump discharge pressure is increased to a pressure that is equal to or larger than the first preset pressure P1 at a predetermined speed, a time period, which is from a time point of reaching of the pump discharge pressure to the first preset pressure P1 to a time point of valve opening the first valve element 62, is defined as a valve opening response time period of the first pressure regulating valve 60. Similarly, in a case where the pump discharge pressure is increased to a pressure that is equal to or larger than the second preset pressure P2 at a predetermined speed, a time period, which is from a time point of reaching of the pump discharge pressure to the second preset pressure P2 to a time point of valve opening the second valve element 72, is defined as a valve opening response time period of the second pressure regulating valve 70. Then, it is set that the valve opening response time period of the second pressure regulating valve 70 is shorter than the valve opening response time period of the first pressure regulating valve 60.

For example, in a case where the pump discharge pressure is decreased to a pressure that is smaller than the first preset pressure P1 at a predetermined speed, a time period, which is from a time point of reaching of the pump discharge pressure to the first preset pressure P1 to a time point of valve closing of the first valve element 62, is defined as a valve closing response time period of the first pressure regulating valve 60. Similarly, in a case where the pump discharge pressure is decreased to a pressure that is smaller than the second preset pressure P2 at a predetermined speed, a time period, which is from a time point of reaching of the pump discharge pressure to the second preset pressure P2 to a time point of valve closing of the second valve element 72, is defined as a valve closing response time period of the second pressure regulating valve 70. Then, it is set that the valve closing response time period of the second pressure regulating valve 70 is shorter than the valve closing response time period of the first pressure regulating valve 60.

Furthermore, the first pressure regulating valve 60 and the second pressure regulating valve 70 are set such that the second preset pressure P2 is higher than the first preset pressure P1. Specifically, the above setting is implemented by setting of the pressure receiving surface area of each of the first valve element 62 and the second valve element 72 and setting of the spring constant of each of the first resilient element 63 and the second resilient element 73. Therefore, the second pressure regulating valve 70 is opened in the state where the first pressure regulating valve 60 is opened.

Furthermore, the first pressure regulating valve 60 and the second pressure regulating valve 70 are set such that a maximum flow rate of the second pressure regulating valve 70 is smaller than a maximum flow rate of the first pressure regulating valve 60. Specifically, an opening cross-sectional area of the flow outlet 61*b*, which is regulated by the first pressure regulating valve 60 and is measured at the full opening position of the first valve element 62, is set to be larger than an opening cross-sectional area of the opening portion, which is regulated by the second pressure regulating valve 70.

The orifice member 11 is installed at a portion of the second return passage B4, which is located on the downstream side of the second pressure regulating valve 70, to restrict a flow rate of the low pressure fuel that flows in the second return passage B4. In this way, the orifice member 11 limits a large change in the pressure (back pressure) on the downstream side of the second valve element 72.

Next, an operation of the high pressure pump 4 will be described.

In response to start of the operation of the internal combustion engine 1, the rotation of the rotatable shaft 1*a* starts, and thereby the reciprocation of the plunger 40 starts. During the operation period of the internal combustion engine 1, the electric motor is driven to operate the feed pump 30. In a downward-moving stroke of the plunger 40, the metering valve 50 is opened, so that the low pressure fuel is supplied from the feed passages B2, C1 into the pressurizing chamber 20*s*. In an upward-moving stroke of the plunger 40, the metering valve 50 is closed, so that the low pressure fuel, which is supplied into the pressurizing chamber 20*s*, is compressed and is thereby pressurized. When the pressurized high pressure fuel reaches the valve opening pressure of the discharge valve 21, the discharge valve 21 is opened. Thereby, the high pressure fuel is fed to the common rail 3 through the high pressure discharge pipe A2.

In the upward-moving stroke of the plunger 40, the metering valve 50 is closed at delayed timing, which is delayed from the time point of starting the upward movement of the plunger 40, and the pressurization of the low pressure fuel starts. As discussed above, the metering valve 50 adjusts the valve closing timing during the upward-moving stroke of the plunger, so that the pressurization start timing of the plunger 40 is adjusted, and thereby the amount (pressurized amount) of the low pressure fuel, which is a pressurizing subject, is adjusted. In other words, the metering valve 50 is a PCV (Pressure Control Valve) that adjusts the valve closing timing during the upward-moving stroke of the plunger 40 and thereby adjusts the discharge amount of the low pressure fuel, which is discharged from the pressurizing chamber 20*s* to the feed passage C1 and the excess discharge passage C3, to adjust the pressurized amount of the fuel.

Next, effects and advantages of the high pressure pump 4 will be described.

In FIG. 2A, an axis of abscissas indicates the number of rotations (a rotational speed) of the trochoid gear of the feed pump 30 per unit time. In FIG. 2A, an axis of ordinates indicates a pump discharge pressure (see a dotted line), which is a pressure of the low pressure fuel immediately after discharging of the low pressure fuel from the feed pump 30, and a feed pressure, which is a pressure of the low pressure fuel fed to the metering valve 50. A waveform, which is indicated by a solid line and is located below the first preset pressure P1 in FIG. 2A, is a pump characteristic waveform that indicates a relationship between the pump rotational speed and the pump discharge pressure. As shown in FIG. 2A, the actual pump characteristic waveform does not become a waveform that is configured such that the pump discharge pressure monotonically increases in response to an increase in the pump rotational speed. Rather, in a more precise sense, the actual pump characteristic waveform becomes a waveform that is configured such that the pump discharge pressure pulsates and increases in response to the increase in the pump rotational speed.

A cause of this pulsation is, for example, the fluctuation of the fuel feed amount, a degree of which depends on the number of teeth of the trochoid gear, at the time of rotating the trochoid gear. Although amplitudes of the pulsation are exaggerated in FIG. 2A to ease the understanding, the pulsation occur at smaller amplitudes than the amplitudes of the pulsation shown in FIG. 2A in reality.

A pulsation center line of the pump characteristic waveform, which is indicated by a dot-dash line in FIG. 2A, indicates an average value of the pump discharge pressure in a pump rotational speed range (a low rotational speed range W) where the pump discharge pressure is smaller than the first preset pressure P1. Furthermore, in the low rotational speed range W, the average value of the pump discharge pressure coincides with an average value of the feed pressure.

As discussed above, when the pump rotational speed is increased, the pump discharge pressure is increased. In a case of a high pressure pump, in which the first pressure regulating valve 60 and the second pressure regulating valve 70 are eliminated unlike the present embodiment, the average value of the discharge pressure is increased beyond the first preset pressure P1 (see the dotted line in FIG. 2A).

In contrast, in the present embodiment, the first pressure regulating valve 60 is installed in the feed passage B2, so that when the pump discharge pressure becomes equal to or larger than the first preset pressure P1, the first pressure regulating valve 60 is opened. Therefore, even when the pump discharge pressure is instantaneously largely pulsated in response to a small change in the pump rotational speed due to the pressure pulsation of the pump characteristic waveform, the average value of the feed pressure can be adjusted to the first preset pressure P1. Thus, in a high rotational speed range, which is above the low rotational speed range W, the average feed pressure is kept to the first preset pressure P1 regardless of the pump rotational speed. Thereby, the low pressure fuel, which has the stable average feed pressure, can be fed to the metering valve 50.

Furthermore, according to the present embodiment, the second pressure regulating valve 70, which has the high degree of responsiveness, is provided. Therefore, the second pressure regulating valve 70 can be opened in response to an instantaneous change in the pump discharge pressure to limit the instantaneous change in the pump discharge pressure although the first pressure regulating valve 60 cannot respond to such an instantaneous change in the pump discharge pressure. Thus, under the circumstance where the average value of the pump discharge pressure is smaller than the second preset pressure P2, it is possible to limit the pulsation of the pump discharge pressure at the high pressure side of the pulsation average of the pump discharge pressure.

In the present embodiment, the second preset pressure P2 is set to be larger than the first preset pressure P1. Therefore, the above-described circumstance refers to the circumstance where the pump rotational speed is in the high rotational speed range, in which the pump rotational speed is above the low rotational speed range W, and the feed pressure is adjusted to the first preset pressure P1. Thus, in the feed pressure waveform at the high rotational speed range, a waveform (a spike waveform), which is equal to or larger than the second preset pressure P2, i.e., a waveform that is located in a triangular area indicated by a dotted line in FIG. 2A is cut by the second pressure regulating valve 70. Thereby, the low pressure fuel, which has the stable feed pressure by removing the spike waveform from the feed pressure waveform with the second pressure regulating valve 70, can be fed to the metering valve 50.

Figure 3:
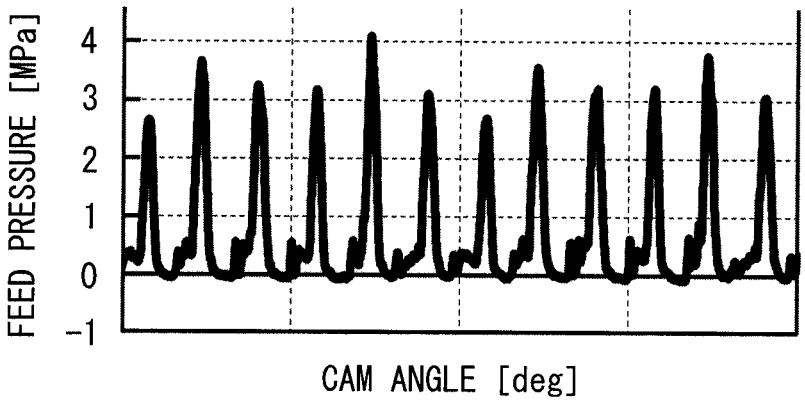
FIG. 3 RELATED ART
FIG. 3 is a graph indicating behavior of a feed pressure relative to a change in a cam angle based on a result of a test that uses a fuel pump of a comparative example of the first embodiment.
Figure 4:
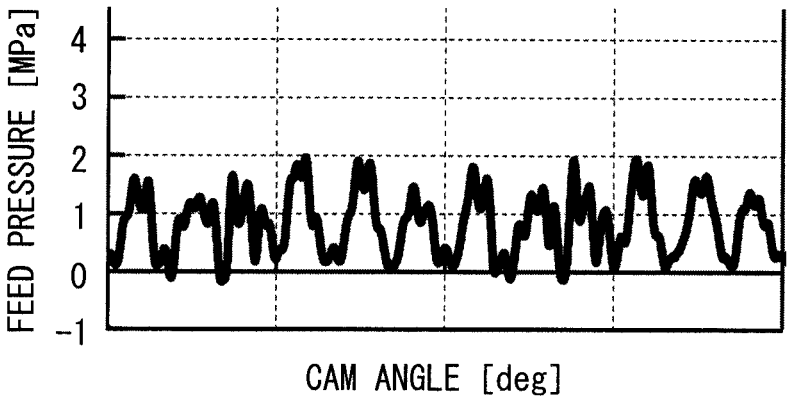
FIG. 4 is a graph indicating behavior of a feed pressure relative to a change in a cam angle based on a result of a test that uses the fuel pump of the first embodiment.

FIGS. 3 and 4 are graphs that show results of tests performed by the inventor of the present application, indicating an advantage of cutting the spike waveform. FIG. 3 shows the result of the test that uses a high pressure pump of a comparative example, in which the second pressure regulating valve 70 and the second return passage B4 are eliminated unlike the present embodiment. FIG. 4 shows the result of the test that uses the high pressure pump 4 of the present embodiment. In these tests, the feed pressure is measured under the condition of that the pump rotational speed of the feed pump 30 is kept constant at a predetermined value in the high rotational speed range. An axis of ordinates in each of FIGS. 3 and 4 indicates a value that is obtained by subtracting the first preset pressure P1 from the measured feed pressure. An axis of abscissas in each of FIGS. 3 and 4 indicates a rotational angle of the cam 1*b*.

Although the feed pressure of the comparative example pulsates in a range of 0 MPa to 4 MPa, the feed pressure of the present embodiment pulsates in a range of 0 MPa to 2 MPa. These results indicate that the amplitude of the pulsation is reduced from 4 MPa to 2 MPa by limiting the spike waveform through the use of the second pressure regulating valve 70. As discussed above, the advantage of the second pressure regulating valve 70 is confirmed by the tests performed by the inventor of the present application.

Here, in the case where the pump rotational speed is in the high rotational speed range, a portion of the fuel, which is discharged from the feed pump 30, is returned from both of the first return passage B3 and the second return passage B4 to the pump upstream side. In the following discussion, the flow rate of the fuel, which is returned from the second return passage B4, will be referred to as a second return flow rate, and the flow rate of the fuel, which is returned from the first return passage B3, will be referred to as a first return flow rate. Additionally, a total of the first return flow rate and the second return flow rate will be referred to as a total return flow rate. Since the degree of responsiveness of the second pressure regulating valve 70 is higher than the degree of responsiveness of the first pressure regulating valve 60, the amount of change in the second return flow rate is larger than the amount of change in the first return flow rate. Therefore, when the second return flow rate gets larger in comparison to the first return flow rate, a ratio of the second return flow rate relative to the total return flow rate is increased. As a result, the spike waveform, which is cut by the second pressure regulating valve 70, may be expanded to the average feed pressure, and thereby the stability of the average feed pressure may possibly be deteriorated.

With respect to this point, in the present embodiment, the maximum flow rate of the second pressure regulating valve 70 is set to be smaller than the maximum flow rate of the first pressure regulating valve 60. Therefore, the feed pressure pulsation can be limited by the cutting of the spike waveform while limiting the possibility of the deteriorating the stability of the average feed pressure. In other words, even when the pump rotational speed is changed, the first return flow rate becomes dominant over the second flow rate, and thereby the average feed pressure can be smoothly changed. Thus, the pressure stability of the low pressure fuel, which is supplied to the metering valve 50, can be implemented.

Furthermore, according to the present embodiment, the second return passage B4 is connected to the portion of the feed passage B2, which is located on the downstream side of the portion of the feed passage B2, to which the first return passage B3 is connected. Therefore, the spike waveform is cut at the location, which is more adjacent to the metering valve 50 in comparison to the case where the second return passage B4 is connected to the upstream side of the first return passage B3 unlike the present embodiment. Thereby, the decreasing of the feed pressure pulsation, which is achieved by the cutting of the spike waveform, can improve a degree of contribution for increasing a degree of accuracy in the discharge amount of the high pressure fuel.

Furthermore, in the present embodiment, there is provided the sub-supply passage B7 that is connected to the feed passage B2 and conducts the low pressure fuel to the portion of the exhaust pipe 1*ex*, which is located on the upstream side of the DPF 5. Therefore, in addition to the supplying of the low pressure fuel, which is discharged from the feed pump 30, to the pressurizing chamber 20*s*, the low pressure fuel, which is discharged from the feed pump 30, can be supplied to the low pressure injection valve 6 that injects the fuel for the purpose of the DPF regeneration. Thus, the feed pump 30, which supplies the low pressure fuel to the pressurizing chamber 20*s*, can be additionally used as a pump that supplies the low pressure fuel to the low pressure injection valve 6.

Furthermore, according to the present embodiment, the second return passage B4 is connected the portion of the feed passage B2, which is located on the upstream side of the portion of the feed passage B2, to which the sub-supply passage B7 is connected. Therefore, the low pressure fuel, from which the spike waveform is cut by the second pressure regulating valve 70, is supplied to the low pressure injection valve 6. Thus, the low pressure fuel, which has the stable pressure that is stabilized by limiting the pressure pulsation, can be also supplied to the low pressure injection valve 6, which is provided for the purpose of the DPF regeneration, in addition to the metering valve 50. Thus, the amount of fuel injection from the low pressure injection valve 6 can be accurately controlled, and thereby it is possible to limit excess or deficiency of the fuel that is injected for the purpose of the DPF regeneration.

Furthermore, according to the present embodiment, there is provided the orifice member 11 that is installed in the second return passage B4 and limits the second return flow rate. Accordingly, a change in the pressure, which is applied to a surface of the second valve element 72 that is other than the pressure receiving surface of the second valve element 72 configured to receive the pump discharge pressure, can be limited, i.e., a change in a back pressure of the second pressure regulating valve 70 can be limited. Therefore, it is possible to limit deterioration in the reliability on the valve opening operation of the second pressure regulating valve 70 at the second preset pressure P2 that would be caused by the change in the back pressure. Thus, the spike waveform can be accurately cut, and thereby the pressure stability of the low pressure fuel, which is supplied to the metering valve 50, can be promoted.

Furthermore, in the present embodiment, the downstream end of the second return passage B4 is connected to the upstream side of the feed pump 30 through the second drain pipe A4 in the fuel system (fuel circuit) while bypassing the cam chamber 10*s*. Therefore, the limiting of the change in the back pressure of the second pressure regulating valve 70 can be promoted. Thus, it is possible to further limit the deterioration in the reliability on the valve opening operation of the second pressure regulating valve 70 at the second preset pressure P2 that would be caused by the change in the back pressure. As a result, it is possible to promote the accurate cutting of the spike waveform.

Second Embodiment

Figure 5:
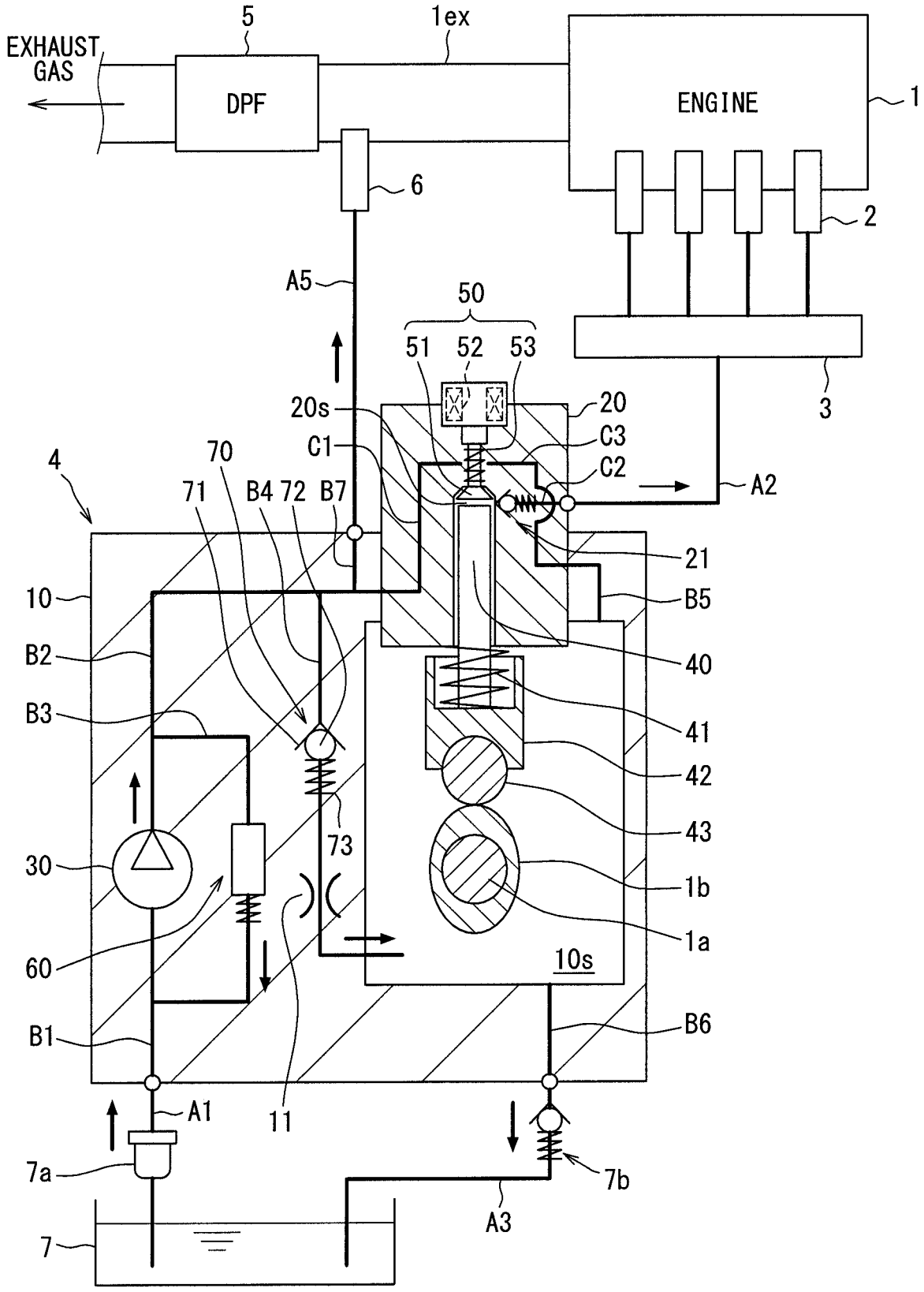
FIG. 5 is a schematic diagram showing a cross section of a fuel pump according to a second embodiment.

In the first embodiment, the downstream end of the second return passage B4 is connected to the second drain pipe A4. In contrast, according to the present embodiment, as shown in FIG. 5, the downstream end of the second return passage B4 is connected to the cam chamber 10*s*.

Accordingly, the low pressure fuel, which is conducted through the second return passage B4, flows into the cam chamber 10*s* and is then merged with the fuel, which flows from the excess discharge passage B5 into the cam chamber 10*s*, and this merged fuel is discharged from the cam chamber 10*a* into the first drain pipe A3 through the cam discharge passage B6. Therefore, it is possible to eliminate the second drain pipe A4 (see FIG. 1), which is dedicated to the second return passage B4. Thus, it is possible to reduce the number of the drain pipes connected to the main body portion 10.

Third Embodiment

Figure 6:
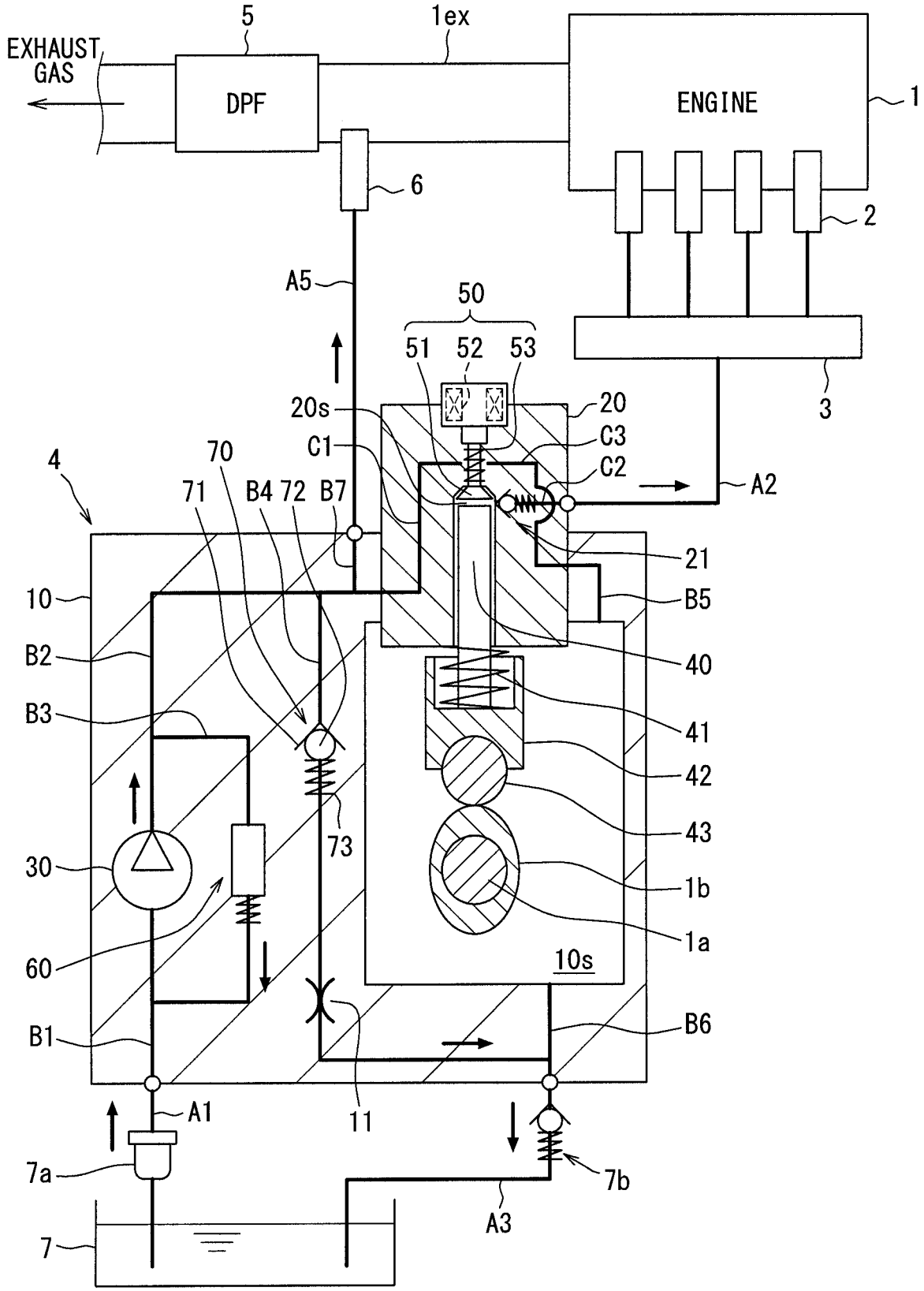
FIG. 6 is a schematic diagram showing a cross section of a fuel pump according to a third embodiment.

In the second embodiment, the downstream end of the second return passage B4 is connected to the cam chamber 10*s*. In contrast, according to the present embodiment, as shown in FIG. 6, the downstream end of the second return passage B4 is connected to the cam discharge passage B6 that is connected to the downstream side of the cam chamber 10*s*.

Accordingly, the low pressure fuel, which is conducted through the second return passage B4, flows into the cam discharge passage B6 while bypassing the cam chamber 10*s* and is then discharged into the first drain pipe A3 together with the fuel, which is discharged from the cam chamber 10*s*. Therefore, it is possible to eliminate the second drain pipe A4 (see FIG. 1), which is dedicated to the second return passage B4. Thus, it is possible to reduce the number of the drain pipes connected to the main body portion 10. Furthermore, the low pressure fuel, which is conducted through the second return passage B4, flows into the cam discharge passage B6 while bypassing the cam chamber 10*s*, so that it is possible to limit a change in the back pressure of the second pressure regulating valve 70, which would be caused by an influence of a change in the pressure of the cam chamber 10*s*. Thus, it is possible to limit the deterioration in the reliability on the valve opening operation of the second pressure regulating valve 70 at the second preset pressure P2 that would be caused by the change in the back pressure.

Fourth Embodiment

Figure 7:
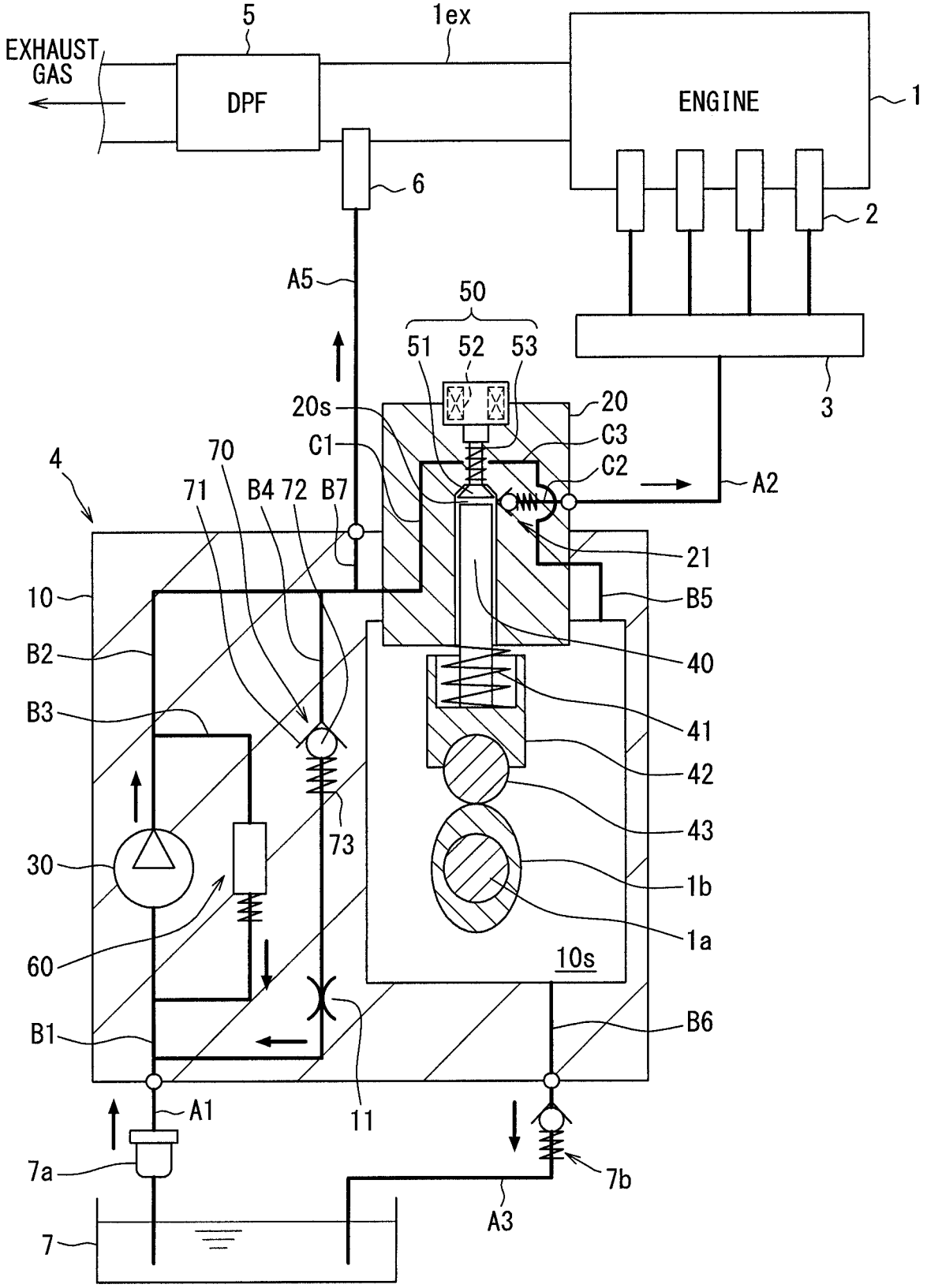
FIG. 7 is a schematic diagram showing a cross section of a fuel pump according to a fourth embodiment.

In the first embodiment, the downstream end of the second return passage B4 is connected to the second drain pipe A4. In contrast, in the present embodiment, as shown in FIG. 7, the downstream end of the second return passage B4 is connected to the suction passage B1.

In this way, the low pressure fuel, which is conducted through the second return passage B4, flows into the suction passage B1 and is then merged with the fuel to be suctioned from the inflow pipe A1 into the feed pump 30, and this merged fuel is suctioned into the feed pump 30. Therefore, it is possible to eliminate the second drain pipe A4 (see FIG. 1), which is dedicated to the second return passage B4. Thus, it is possible to reduce the number of the drain pipes connected to the main body portion 10.

Furthermore, according to the present embodiment, the low pressure fuel, which is conducted through the second return passage B4, is returned to the downstream side of the fuel filter 7*a*. Therefore, the flow rate of the fuel, which passes through the fuel filter 7*a*, can be reduced in comparison to the case where the low pressure fuel, which is conducted through the second return passage B4, is returned to the fuel tank 7. Thus, the size of the fuel filter 7*a* can be reduced, and a maintenance interval of the fuel filter 7*a* can be lengthened.

Other Embodiment

Although the embodiments of the present disclosure have been described, the present disclosure should not be limited to the above embodiments and may be applied to various other embodiments and combinations of the embodiments.

For instance, in each of the above embodiments, the upstream end of the first return passage B3 and the upstream end of the second return passage B4 are connected to the feed passage B2 that is formed in the main body portion 10. Alternatively, the upstream end of the first return passage B3 and the upstream end of the second return passage B4 may be connected to the feed passage C1 that is formed in the cylinder portion 20.

In each of the above embodiments, the feed pump 30 is provided at the main body portion 10 and is included in the high pressure pump 4. Alternatively, the feed pump 30 may be placed at the outside of the high pressure pump 4 and may be connected to the inflow pipe A1.

In each of the above embodiments, the feed pump 30 is configured to use the electric motor as the drive source to drive the feed pump 30. Alternatively, the feed pump 30 may be configured to use an output of the internal combustion engine 1 as a drive source to drive the feed pump 30. Specifically, the trochoid gear of the feed pump 30 may be configured to use a drive force, which is transmitted from the output shaft of the internal combustion engine 1, to rotate the trochoid gear of the feed pump 30.

In each of the above embodiments, the second preset pressure P2 is set to be larger than the first preset pressure P1. Alternatively, the second preset pressure P2 may be set to be smaller than the first preset pressure P1. In such a case, the second pressure regulating valve 70 is operated to cut the spike waveform in the low rotational speed range W, and thereby the second pressure regulating valve 70 contributes to the stabilization of the feed pressure in the low rotational speed range. In this case, the second pressure regulating valve 70 is always opened in the high rotational speed range.

In each of the above embodiments, the maximum flow rate of the second pressure regulating valve 70 is set to be smaller than the maximum flow rate of the first pressure regulating valve 60. Alternatively, the maximum flow rate of the second pressure regulating valve 70 may be set to be larger than the maximum flow rate of the first pressure regulating valve 60.

In each of the above embodiments, the first pressure regulating valve 60 has the structure (e.g., the spool valve) that changes the opening degree of the first valve element 62 according to the pump discharge pressure under the circumstance where the pump discharge pressure is equal to or larger than the first preset pressure P1. Alternatively, the first pressure regulating valve may have a structure (e.g., a ball valve) that maintains a constant opening degree thereof regardless of the pump discharge pressure.

In each of the above embodiments, the second pressure regulating valve 70 has the structure (e.g., the ball valve) that maintains the constant opening degree of the second valve element 72 regardless of the amount of the pump discharge pressure under the circumstance where the pump discharge pressure is equal to or larger than the second preset pressure P2. Alternatively, the second pressure regulating valve may have a structure (e.g., a spool valve) that changes the opening degree thereof according to the pump discharge pressure.

In each of the above embodiments, the metering valve 50 is the PCV that adjusts the valve closing timing during the upward-moving stroke of the plunger 40 and thereby adjusts the discharge amount of the low pressure fuel, which is discharged from the pressurizing chamber 20*s*, to adjust the pressurized amount of the fuel. Alternatively, the metering valve may be an SCV (Suction Control Valve) that is placed in the low pressure fuel circuit, such as the feed passages B2, C1, to adjust the amount of flow restriction of the circuit and thereby to adjust the amount of the fuel to be supplied to the pressurizing chamber 20*s* before supplying the fuel to the pressurizing chamber 20*s*.

In each of the above embodiments, there is provided the sub-supply passage B7 that conducts the low pressure fuel to the low pressure injection valve 6. Furthermore, the feed pump 30, which supplies the low pressure fuel to the pressurizing chamber 20*s*, is used as the pump that supplies the low pressure fuel to the low pressure injection valve 6. Alternatively, the above-described sub-supply passage B7 may be eliminated.

In each of the above embodiments, the upstream end of the second return passage B4 is connected to the portion of the feed passage B2, which is located on the upstream side of the sub-supply passage B7. Alternatively, the upstream end of the second return passage B4 may be connected to another portion of the feed passage B2, which is located on a downstream side of the sub-supply passage B7.

The high pressure pump 4 shown in FIG. 1 has the structure of the cam-and-roller type where the contact portion 43 in a form of a roller is upwardly driven by the cam 1*b* to drive the plunger 40. Alternatively, the high pressure pump may be modified to a high pressure pump of a tappet sliding type that includes: a member, which is displaceable upward, downward, leftward and rightward through an eccentric shaft; and a tappet, which is pushed by this member upward or downward while sliding leftward or rightward to drive the plunger 40 by the tappet.

What is claimed is:

1. A fuel pump configured to pressurize low pressure fuel suctioned into a pressurizing chamber and discharge high pressure fuel, which is pressurized in the pressurizing chamber, from the pressurizing chamber, the fuel pump comprising:

a feed passage that supplies the low pressure fuel, which is fed from a feed pump, to the pressurizing chamber;

a metering valve that is installed in the feed passage, wherein the metering valve adjusts a supply amount of the low pressure fuel supplied to the pressurizing chamber or adjusts a discharge amount of the low pressure fuel discharged from the pressurizing chamber, so that the metering valve adjusts an amount of the low pressure fuel that is a pressurizing subject to be pressurized in the pressurizing chamber;

a first return passage that is connected to a portion of the feed passage located on an upstream side of the metering valve and returns the low pressure fuel to an upstream side of the feed pump;

a first pressure regulating valve that includes a first valve element, which is configured to open and close the first return passage, and a first resilient element, which applies a resilient force to the first valve element toward a valve closing side, while the first valve element is opened against the resilient force of the first resilient element in a case where a pressure of the low pressure fuel becomes equal to or larger than a first preset pressure;

a second return passage that is connected to a portion of the feed passage located on an upstream side of the metering valve and returns the low pressure fuel to the upstream side of the feed pump; and a second pressure regulating valve that includes a second valve element, which is configured to open or close the second return passage, and a second resilient element, which applies a resilient force to the second valve element toward a valve closing side, while the second valve element opens against the resilient force of the second resilient element in a case where the pressure of the low pressure fuel becomes equal to or larger than a second preset pressure, wherein:

the first pressure regulating valve and the second pressure regulating valve are configured such that a degree of responsiveness of valve opening and closing of the second pressure regulating valve is higher than a degree of responsiveness of valve opening and closing of the first pressure regulating valve, and the first pressure regulating valve and the second pressure regulating valve are configured such that the second preset pressure is larger than the first preset pressure.

2. The fuel pump according to claim 1, wherein the first pressure regulating valve and the second pressure regulating valve are configured such that a maximum flow rate of the second pressure regulating valve is smaller than a maximum flow rate of the first pressure regulating valve.

3. The fuel pump according to claim 1, comprising:

a plunger that is reciprocated by a rotational drive force of a cam to pressurize the fuel in the pressurizing chamber; and a cam chamber that receives the cam, wherein:

a downstream end of the second return passage is connected to the upstream side of the feed pump while bypassing the cam chamber.

4. The fuel pump according to claim 1, comprising:

a plunger that is reciprocated by a rotational drive force of a cam to pressurize the fuel in the pressurizing chamber;

a cam chamber that receives the cam; and a cam discharge passage that discharges the fuel from the cam chamber, wherein:

a downstream end of the second return passage is connected to the cam chamber.

5. The fuel pump according to claim 1, comprising a suction passage that is connected to a suction inlet of the feed pump, wherein a downstream end of the second return passage is connected to the suction passage.

6. The fuel pump according to claim 1, comprising an orifice member that is installed in the second return passage and limits a flow rate of the second return passage.

7. The fuel pump according to claim 1, wherein an upstream end of the second return passage is connected the portion of the feed passage, which is located on a downstream side of the portion of the feed passage, to which the first return passage is connected.

8. The fuel pump according to claim 1, wherein:

the fuel pump is configured to be applied to a combustion system that includes a particulate filter installed in an exhaust pipe of an internal combustion engine while the particulate filter is configured to capture a particulate component contained in exhaust gas of the internal combustion engine;

the fuel pump is configured to discharge the high pressure fuel as fuel to be combusted in the internal combustion engine; and the fuel pump comprises a sub-supply passage that is connected to a portion of the feed passage and conducts the low pressure fuel to a portion of the exhaust pipe located on an upstream side of the particulate filter.

9. The fuel pump according to claim 8, wherein an upstream end of the second return passage is connected to the portion of the feed passage, which is located on an upstream side of the portion of the feed passage, to which the sub-supply passage is connected.

10. The fuel pump according to claim 1, comprising:

a plunger that is reciprocated by a rotational drive force of a cam to pressurize the fuel in the pressurizing chamber;

a cam chamber that receives the cam; and a cam discharge passage that discharges the fuel from the cam chamber, wherein:

a downstream end of the second return passage is connected to the cam discharge passage.

* * * * *